United States Patent [19]

Barthelemy et al.

[11] Patent Number: 4,957,542

[45] Date of Patent: Sep. 18, 1990

[54] PROCESS FOR TREATING LIQUID STEELS BY INJECTING GAS THROUGH THE LADLE BOTTOM

[75] Inventors: Philippe Barthelemy, Sevres; Christian Naturel, Brignais, both of France

[73] Assignees: Vallourec Industries, Boulogne-Billancourt; Savoie Refractaires, Venissieux, both of France

[21] Appl. No.: 366,501

[22] Filed: Jun. 15, 1989

[30] Foreign Application Priority Data

Jun. 17, 1988 [FR] France ..... 88 08479

[51] Int. Cl.[5] ..... C21C 7/00

[52] U.S. Cl. ..... 75/10.39; 75/556; 75/558; 75/10.41; 266/218

[58] Field of Search ..... 75/10.39, 59.1, 49

[56] References Cited

U.S. PATENT DOCUMENTS

| | | | |
|---|---|---|---|
| 2,826,494 | 3/1958 | Drummond | 75/59.1 |
| 4,382,817 | 5/1983 | Vayssiere | 75/59.1 |
| 4,647,306 | 3/1987 | Abratis et al. | 75/49 |

FOREIGN PATENT DOCUMENTS

| | | |
|---|---|---|
| 0032350 | 12/1980 | European Pat. Off. . |
| 0188891 | 12/1985 | European Pat. Off. . |
| 2162204 | 7/1985 | United Kingdom . |

*Primary Examiner*—Peter D. Rosenberg

*Attorney, Agent, or Firm*—Oblon, Spivak, McClelland, Maier & Neustadt

[57] ABSTRACT

A process for the in-ladle treatment of liquid steels by injecting gas through the ladle bottom. The process comprises injecting at least one inert gas from locations which are distributed over the ladle bottom in such a way as to form at the surface of the liquid steel an annular swelling, the outside edge of which is close to the inside edge of the lining of the wall of the ladle. An oxidizing gas may be mixed with the inert gas for decarburization. The process is applied in particular to the treatment of carbon steels.

20 Claims, 2 Drawing Sheets

PROCESS FOR TREATING LIQUID STEELS BY INJECTING GAS THROUGH THE LADLE BOTTOM

BACKGROUND OF THE INVENTION

1. Field of the Invention

The process and the apparatus which are the subject-matter of the present invention are concerned with the treatment of liquid steel in a ladle by means of gas injected from particular blowing elements which are suitably disposed in the bottom of the ladle to effect dehydrogenation, decarburization and renitridation of steels, in particular stainless steels, and decantation of killing inclusions.

2. Discussion of the Background

Treatment of liquid steels in a ladle by the injection of gas through the ladle bottom or by way of immersed lances has been used on an industrial scale for around twenty years for the purpose of homogenizing the temperature of the metal, desulphurizing it in contact with the slag and removing the killing inclusions.

The article by Grabner and Hoffgen "Einsatz und Verschleiss von Spulsteinen in der Sekundarmetallurgie" in Radex Rundschau issue 3, (1983), pages 179 to 209, reviews the conditions under which that procedure is usually carried into effect and its uses, the argon or nitrogen gas flow rates used as well as the design and the number of porous plugs used. The plugs are generally conical, being 1 or 2 in number, and they are generally disposed at two-thirds of the radius of the ladle, as determined from the center of the ladle. The total area of the porous plugs in contact with the liquid steel is between 25 and 190 $cm^2$ depending on the size of the ladle and the flow rates used are between 3 and 10 liters per minute and per $cm^2$ of surface area of porous plug, in contact with the liquid metal.

Electric Furnace Steel Making, volume II, Theory and Fundamentals, by D. C. Hilty, R. W. Farley and D. J. Garde, edited 1967 by E. Sims, also sets out the thermodynamic elements required to understand the mechanism of decarburization under partial CO pressure, (pages 124, 125 and 171 to 175) for steels with a high proportion of chromium.

The Revue de Metallurgie, January (1986), pages 25 to 41, by C. Gatelier and H. Gaye sets out thermodynamic considerations relating more particularly to the exchanges between the liquid steel and the hydrogen and nitrogen gases, the dimensioning of the bubbles of gas emitted as well as the method of calculating their rate of rise.

However, in spite of the efforts involving increasing the gas flow rates conventionally used with the known porous plugs and increasing the duration of the treatment to the limits permitted by the temperature losses in the ladle, it is not possible to provide either for complete decantation of the inclusions or sufficient dehydrogenation or renitridation of nitrogen-bearing stainless steels to the desired value or decarburization under a low partial CO pressure in order to achieve very low proportions of carbon which are below 0.025% by weight for stainless or carbon steels. The volumes of the argon-oxygen mixture are such that the conventional porous plugs do not provide an adequate flow rate and the rise in temperature at the location of the plugs resulting from combustion is also excessive.

Thus, for the purposes of dehydrogenating steels, the present procedure in its general principle involves subjecting the metal to a vacuum, generally about 1 Torr, with the layers of steel being constantly renewed so that the partial pressure of hydrogen dissolved in the metal is always higher than that of the hydrogen in the level of vacuum in question so that the hydrogen can diffuse.

Although renitridation of nitrogen-bearing stainless steels (0.1 to 0.4% by weight nitrogen) is already effective in the AOD converter (Argon Oxygen Decarburizing process), by virtue of replacing argon with nitrogen as the gas for dilution of the CO formed, it is not sufficient and must be supplemented by final additions, generally of nitrided ferrochromium, which are highly expensive.

The production of steels with a very low carbon content of less than 0.025 wt% or steels with a high chromium content in which combustion of the carbon must be effected under a partial CO pressure of less than unity, the pressure being dependent on the carbon content and temperature, in AOD converters or in vacuum degassing installations in order to limit the degree of oxidation of the metal. In AOD converters, the partial CO pressure is achieved by dilution. In vacuum degassing installations, oxygen is injected by means of a lance at the desired pressure to produce the desired CO pressure. These apparatuses are frequently referred to as RH-OB or VOD in the specialist literature.

At the present time, bearing steels, after a first treatment to decant the inclusions in the ladle, are subjected to a complementary operation generally with an elevator under vacuum (R.H.) in which the rate of circulation of the metal is very high. This circulation takes place under turbulent flow conditions, which increases the probability of elementary inclusions of alumina, the size of which is close to a micron, agglomerating and being of a sufficient size to decant in the liquid steel by virtue of a difference in density or clinging to the refractory wall.

French Pat. No. 2,223,467 discloses a process for circulating the whole of a cast iron bath, by pneumatic means, in a ladle, and not in an apparatus under vacuum. This process is concerned with introducing desulphurizing agents such as calcium carbide or graphitization innoculating agents, into the very heart of the mass of metal. As these agents are of a density which is two to three times less than that of the metal, they impose on the central downwardly directed flow of metal, a speed which is greater than that of the upward movement of the agents, thereby imposing a porous ring configuration. The width of the configuration can attain a quarter of the inside diameter of the ladle, or three quarters of the surface area of the bottom of the ladle.

The object of the present invention is entirely different from that which French Pat. No. 2,223,467 seeks to attain, since the present invention seeks to multiply the metal-gas exchange surfaces while retaining the individuality of each of the small bubbles emitted and their low rate of rise, while also seeking to concentrate the slag at the center of the free upward surface of the liquid metal so that the slag cannot be entrained right within the liquid steel. This requires mixing surface areas which are very much smaller than the above-indicated surfaces, very specific gas flow rates, precise positioning of the stirring elements and a suitable level of porosity.

The problems of the above-discussed industrial installations are that they require very high levels of capital investment, giving rise to high levels of heat losses, often requiring reheating of the metal either by alumino or silico-thermy (RH-OB and AOD), or by means of electric arcs in the ladle. The treatment costs are therefore high.

SUMMARY OF THE INVENTION

In the process for treatment in a ladle, which is the subject-matter of the present invention, the object is to multiply in the treatment ladle the surfaces involving contact between the liquid metal and the treatment gas, and to increase the residence time of the gas in the metal, while preventing the bubbles emitted, the volume of which is close to 0.5 $cm^3$ from coalescing, which permits them to rise slowly and have a very large gas-metal exchange surface area.

The present method also utilizes the substantial gas flow rates which are necessitated by virtue of the large volume of gas required for dehydrogenation in a short period of time for minimizing the heat losses due to the duration of the treatment.

An object of the invention is to provide for intumescence which is the calmest and the best distributed at the free surface of the liquid metal, having regard to the high gas flow rate used in order to prevent liquid steel being splashed and thrown around and to prevent fragmentation and then entrainment of slag right into the metal.

Another object is to circulate the majority of the liquid steel contained in the ladle in a turbulent flow condition to enhance the probability of encountering the solid elementary inclusions such as alumina or titanium nitrides, at the temperature of the liquid steel, so that they can undergo agglomeration much more quickly and attain a sufficient size to decant or cling to the refractory walls of the ladle.

Another object is to concentrate the liquid slag at the center of the surface of the ladle, where the rate of circulation of the steel is the lowest.

A further object is, in the case of injection of an oxygen-based mixture, to distribute the heat resulting from combustion in order to avoid heating to excessively high temperatures, endangering the service life of the injection refractory materials and also providing that the heat given off by combustion of the oxygen at the tips of the injection holes is rapidly swept away by the less hot liquid steel from the upper part of the ladle.

According to the invention the process for treatment of a liquid steel is applied to a steel which in a first phase was produced in the liquid state and then transferred into a ladle. This steel is then treated in the ladle by a very large number of fine bubbles of gas or gas mixture which is injected through the ladle bottom from injection elements disposed at a distance from the center thereof which is at least equal to half its radius and spaced from the corresponding wall at the edge of the bottom of the ladle by a distance which is at least equal to a tenth of the radius. At the surface of the liquid steel, this results in an annular swelling (intumescence), the outer edge of which is close to the inward edge of the lining of the wall of the ladle.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
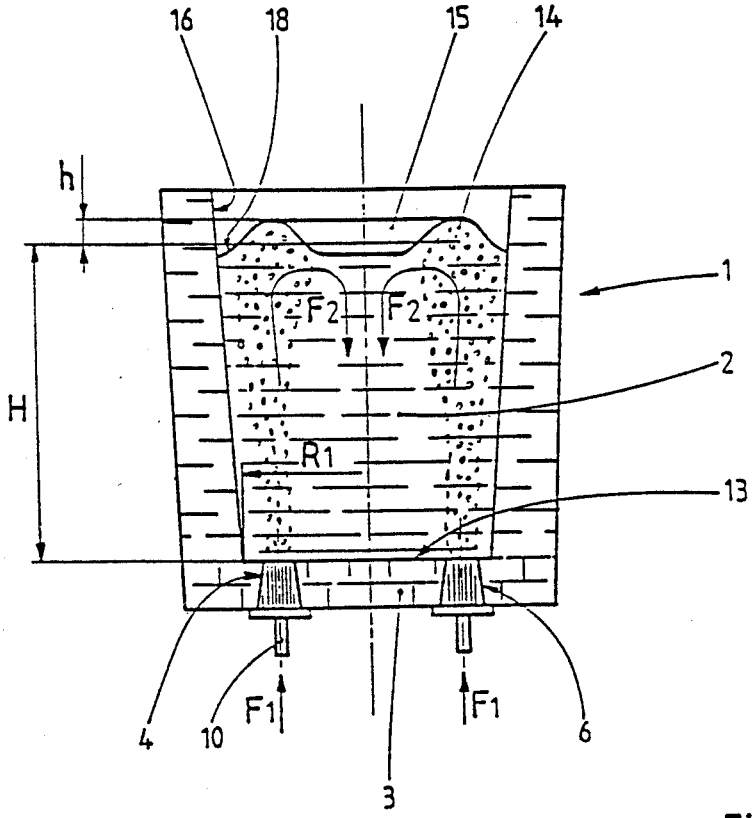
FIG. 1 is an elevational view and in section taken along line X—X in FIG. 2 of a ladle for the treatment of the liquid steel according to the invention.

The nature of the gas injected depends on the treatment to be carried out. The gas may comprise an inert gas in air (most generally, argon) or nitrogen or carbon dioxide or a mixture of the foregoing gases.

Preferably the injection elements are of an area of between S/10 and S/30, wherein S is the area of the bottom of the ladle and the gas injection pressure is so regulated that the mean unitary flow rate per $cm^2$ of area of injection element is between 0.1 and 0.8 liter/minute in the case of treatments for dehydrogenation, decantation of inclusions and nitridation of stainless steels with a high nitrogen content.

Preferably, when carrying out a decarburization treatment the supply of heat resulting from combustion of the gas mixture such as oxygen-argon or oxygen-nitrogen cannot be greater than that resulting from the combustion of 0.1 to 0.6 liter of pure oxygen per minute and per $cm^2$ of area of injection elements. The proportion of argon or nitrogen, which is variable during the operation, depends on the carbon content and the temperature and will be regulated so that the partial CO pressure obtained makes it possible to have the proportion of oxygen dissolved in equilibrium with the slag containing iron oxide, in the case of carbon steels or with the slag containing chromium oxide, in the case of steels, with a high chromium content.

Preferably the injection of gas by means of the injection elements is effected either through oriented pores or passages, whose cross section perpendicular to the gas flow is no greater than 0.8 $mm^2$, the total area of the passages being between 15 and 40 $mm^2$ per $dm^2$ of area of injection elements, or through slots which may be straight (linear) or curved, of a thickness which is less than or equal to 0.4 mm. The slots are separated from each other by a distance which is preferably between 1 and 3 cm, the total area of the slots being between 45 and 105 $mm^2$ per $dm^2$ of area of injection element.

By way of indication, the injection pressures used corresponding to the foregoing values will be on the order of a maximum of 4 bars above the ferrostatic pressure at the bottom of the ladle, when using passages or pores, and on the order of a maximum of 1 bar and even 0.5 bar above the ferrostatic pressure at the bottom of the ladle, when using slots.

The injection locations may be generally distributed in a continuous or discontinuous annular or pseudo-annular zone. Preferably the greatest angular distance between the injection locations, as seen from the center of the ladle, is no greater than 30°.

The permeable injection elements are of refractory materials and may be of any shape: cylindrical, conical, pyramidal, parallepipedic or others. They are advantageously covered over all their surfaces, except for that which is in contact with the liquid steel, by a steel plate which is connected to the gas supply tube on the side which, after having been set in position in the bottom of the ladle, faces towards the outside thereof. The permeable elements may be disposed in a fixed or removable fashion. Once fitted, they are part of the ladle bottom.

Distribution of the treatment gas to all of the injection elements may be effected for example from a central feed which may or may not be connected to one of the injection elements.

It is possible to provide in the ladle bottom a single annular porous refractory member of continuous annular shape or comprising a break or a plurality of porous refractory members which are positioned in a generally annular fashion, the angular width of each of the zones which are devoid of permeable elements, as viewed from the center of the ladle, being no greater than 30° and preferably 25°.

Preferably, the operations for treatment of the steel in the ladle will be effected under a cover permitting collection of the fumes and protection of the ambient atmosphere, while reducing heat losses. It is possible to reheat the liquid steel and the slag in the ladle during the injection of at least one gas, for example, by means of one or more electric arcs which pass through the layer of liquid slag which is formed within the intumescence ring.

The process according to the invention is applied in particular to the dehydrogenation of steels by virtue of the multiplication of the bubble-liquid metal contact surfaces, permitting balancing of the partial pressures as between the hydrogen contained in the liquid steel and that which is admitted in the bubbles. Satisfactory results are obtained by passing a volume of neutral gas through the liquid steel on the order of from 0.5 to 1.5 $Nm^3$ per ton of liquid metal.

The process according to the invention also permits an acceleration in agglomeration of the solid inclusions in the case of steels whose deoxidation or denitridation products are solid (alumina or titanium nitride for example), which are very rapidly entrained into the layer of slag. It is thus possible in record time to reduce the total proportion of oxygen in relation to the semi-finished product to about 1.5 times the proportion of dissolved oxygen in the corresponding liquid steel by the sole injection of neutral gas at the bottom.

The process according to the invention may also be applied to the decarburization of steels with a very low carbon content, which may or may not be microalloyed and in particular those containing less than 0.05% of carbon. It may also be applied to the decarburization of steels with a high chromium content, which may or may not be martensitic, or austenitic or austeno-ferritic chrome nickel steels.

The process according to the invention may also be applied to the nitridation of stainless steels with a high nitrogen content (for example 0.2 to 0.4% by weight) in which decarburization under a low partial CO pressure is achieved by means of an oxygen-nitrogen mixture and the final nitrogen content is regulated after killing and desulphurization of the metal by the injection of pure nitrogen.

The invention also concerns a ladle having a ladle bottom and a side wall, for effecting the treatment of a liquid steel in accordance with the process of the invention. The ladle is provided with a ladle bottom comprising injection elements connected to gas supply means, the total area of which is between S/10 and S/30, wherein S is the area of the bottom of the ladle. The injection elements are disposed at a distance from the center of the ladle bottom which is at least equal to half its radius and spaced from the internal wall of the ladle by a distance which is at least equal to a tenth of the radius. The injection elements comprise either pores or passages whose unitary cross section is less than 0.8 $mm^2$ the total area being between 15 and 40 $mm^2$, per $dm^2$ of injection element, or slots whose thickness is less than 0.4 mm, the total area being between 45 and 105 $mm^2$ per $dm^2$ of injection elements.

The preferred embodiments of the ladle and in particular the structure of the injection elements at the bottom of the ladle have already been described above in relation to the description of the process.

The Figures and the following example provide a non-limitative description of the embodiments of the apparatus according to the invention and the manner of performing the process according to the invention using as an example the decarburization of a steel containing about 13% of Cr and the dehydrogenation and decantation of the inclusions of a bearing steel of the type 100 C6 (AFNOR standard).

Shown in FIG. 1 is a ladle 1 according to the invention which permits treatment by the process also according to the invention of a volume of liquid steel 2.

Figure 2:
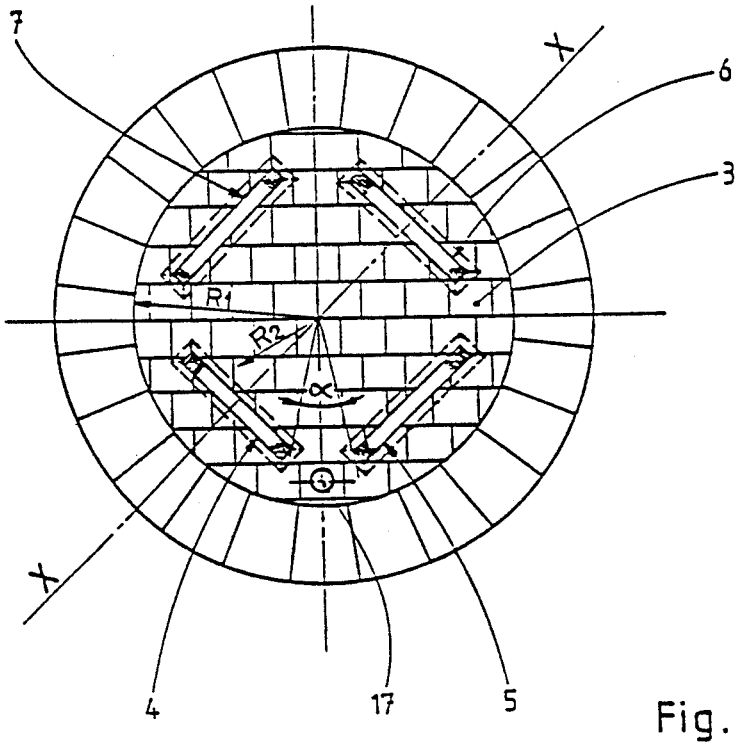
FIG. 2 is a plan view of the bottom of the ladle shown in FIG. 1.
Figure 3:
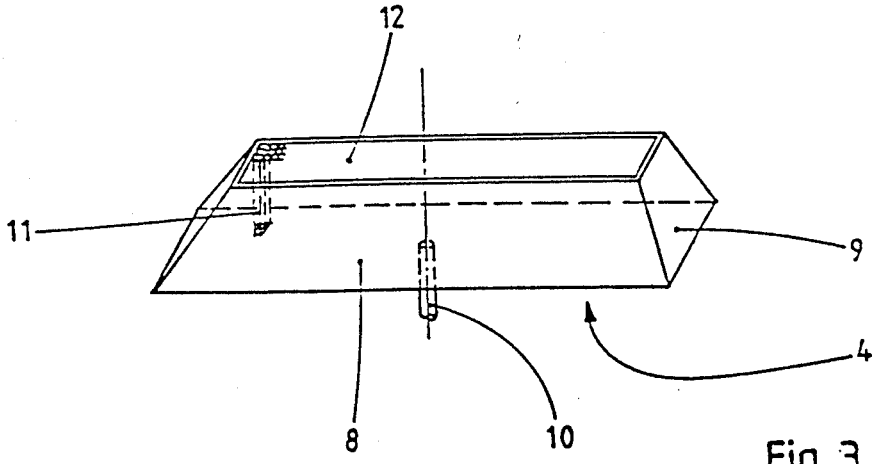
FIG. 3 is a perspective view of a porous refractory member used in the ladle shown in FIGS. 1 and 2.

As shown in FIGS. 2 and 3, the bottom 3 of the ladle is provided with porous refractory members 4, 5, 6 and 7 of a truncated pyramid shape. The side walls of the above-mentioned members as indicated at 8 and 9 are covered with a steel plate which is sealingly connected at the level of the large base to the gas feed tube as indicated at 10. The refractory members have oriented passages or pores passing therethrough, as indicated at 11, which communicate the surface of the large base of the member with that of the small base 12. As shown in FIGS. 1 and 2, the small base 12 is at the level of the upward face 13 of the ladle bottom. The oriented pores 11 are of a mean diameter of 0.8 mm. Each of the porous refractory members has 500 pores passing therethrough, being distributed over the surface of the small base which in the case shown in the Figure is of an area of 1050 $cm^2$ (100 cm in length and 10.5 cm in width). The total area "SP" of the small bases of the 4 porous members is therefore 4200 $cm^2$ for a total number of pores "nt" of 2000. The area "S" of the ladle bottom is 4.9 $m^2$, corresponding to a radius (Rl) of 1.25 m.

It can be seen that the ratio SP/S is equal to 0.085, which value is within the preferred range. Likewise the area of the pores per $dm^2$ is 24 $mm^2$ which value is also within the preferred range. Finally it can be seen from FIG. 2 that the porous refractory members are entirely outside the circle of a radius R2 corresponding to half the radius Rl, namely 0.625 m, and are spaced by more than R/10, that is 0.125 meter, from the edges of the bottom of the ladle. It can also be noted that the greatest annular width of a zone which is without pores, as seen from the center of the ladle bottom, corresponds to the angle "$\alpha$" which is equal to 25°. The angle "$\alpha$" in this example is smaller than the maximum angular width of 30° of a zone which is without pores in the apparatus according to the invention. The height "H" of liquid steel in the rest condition in the ladle is about 2.5 m for a weight of steel "t" of 80 tons.

A total volume of gas of about 1600 Nl/mn is injected through the ladle bottom, as indicated by F1, corresponding to 20 Nl/t/min or approximately 0.380 N1/min per $cm^2$ of area of the porous members. It can be seen that, by virtue of the structure of the ladle bottom according to the invention, it is possible to have, per $cm^2$ of porous area, a very low gas flow rate of between 0.1 and 0.8 liter/min/$cm^2$ which makes it possible to create a large number of bubbles of very small dimensions, which have very little chance of coming together and fusing during their upward movement through the liquid steel. The assembly of such bubbles causes a swirling movement of the liquid steel over a vast annular zone involving a very substantial volume, the outside edge 18 of which is close to the inside edge of the ladle wall.

In this way the annular swelling indicated at 14 is formed, being of a height "h" above the level of the steel in the rest condition, the swelling 14 containing the slag 15 in the axial zone and creating a permanent zone of exchange with the slag, of large surface area and at a high level of activity. The arrows F2 show the movement of the cooler liquid steel with the return movement towards the ladle bottom in the axial zone. The low unitary flow rate of the pores, which is associated with the large area that they cover over the bottom of the ladle and their geometrical arrangement over the ladle bottom thus make it possible to achieve a combination of results which are attractive in regard to treatment of steel in a ladle.

The apparatus according to the invention also makes it possible to reheat the liquid steel and the slag by means, for example, of one or more electric arc heating electrodes (not shown) disposed above the liquid steel in the zone which is close to the axis. By using relatively short arcs which are at least partially immersed in the slag, this arrangement provides for effective reheating without the risk of overheating of the upper zones of the refractory walls of the ladle by virtue of the protective effect due to the annular swelling 14. At the end of the treatment, the steel is poured through the tap hole 17.

The casting ladle described above can be used in particular, for treating a steel containing about 13% chromium by means of the process according to the invention.

EXAMPLES

Example 1

A mother steel of the type comprising about 13% chromium was produced in a conventional manner from scrap iron, carburized ferrochromium and the usual additives. This steel was decarburized in a furnace until it had a 0.4% carbon content and was then poured into a ladle which afforded a free or clear portion of sufficient height, while minimizing the amount of slag from the furnace. The composition of the ladle steel was then as follows:

Cr 13.3% by wt.
Si 0.010% by wt.
C 0.4% by wt.
Mn 0.4% by wt.

The mother steel was covered with lime in grain form and a little spar. An oxygen-argon mixture with an increasing argon content and a constant oxygen flow rate was injected through the ladle bottom. Formed at the surface of the steel was a substantial intumescence which was permitted by virtue of the height of the free portion in the ladle 16. The percentage of oxygen by volume was progressively reduced from 80% to about 52%. This makes it possible to reduce the carbon content to 0.08% without scorification of the chromium by virtue of a reduced level of activity of the oxygen in the metal, without exceeding a temperature of 1680° C. Then, complementary treatments for deoxidation and killing, adjustment to composition and decantation of the inclusions were performed, while continuing with the injection of argon alone at a flow rate of 10 liters/ton/min for about 35 minutes.

The volume of oxygen injected by the permeable elements was close to 140 $m^3$.

Final analysis then gave the following composition:

Cr 13.03% by wt.
C 0.090% ""
Mn 0.8% ""
Si 0.27% ""

The steel was then poured. The chromium yield was 98%. The emission of brown fumes was very much lower than that of conventional processes.

It will be noted that ladle decarburization at the temperature noted above would not have been possible with a flow of pure oxygen without substantial scorification of the chromium, which would have been difficult and expensive to reduce in the final deoxidation step. In addition the temperatures attained would have been higher and would have resulted in rapid and dangerous deterioration in the injection bricks. The low flow rate of oxygen injected per $cm^2$ of area of the porous members, in association with the cooling effect due to dilution by means of the argon and a scavenge effect in relation to the surface of the injection elements by the less hot liquid steel makes it possible to limit the heat resulting from combustion of the oxygen at the surface of the injection elements, and to remove it as it is produced.

Example 2

The second example involves producing a pouring of 60T in an electric furnace with an eccentric tap hole of a steel of type 100 $C_6$ with 1.1% of carbon and 1.5% of chromium from scrap iron. The steel was poured into a ladle provided with the injection system according to the invention, with the usual additions, and 300 kg of fresh, very dry lime and 30 kg of fluoropar were added.

The composition of the steel was as follows:

C 1.1% by wt.
Cr 1.5% by wt.
Mn 0.5% by wt.
Si 0.35% by wt.
S 0.030% by wt.
Al 0.100% by wt.

The temperature was 1600° C. The ladle was transported to an installation for treatment in the ladle with reheating using 3 graphite electrodes so as to produce a final temperature of 1630° C. Throughout the operation the ladle was under a cover so that the atmosphere above the liquid steel was free of oxygen and hydrogen from the atmosphere.

Throughout the operation the steel was stirred by a flow of pure argon at a flow rate of 1 $Nm^3$/min for a period of 1 hour, diffused by 4000 $cm^2$ permeable elements comprising 60 passages having unitary cross sections of 0.5 $mm^2$ per $dm^2$ of area of permeable elements.

After treatment for 1 hour the composition of the steel was as follows:

C 1.1% by wt.
Cr 1.5% ""
Mn 0.530% ""
Si 0.360% ""
Al 0.015% ""
S 0.015% ""

The oxygen activity as measured was 4 ppm. The steel was then poured into an ingot mold entirely in the absence of air to avoid any parasitic rehydrogenation or reoxidation reactions.

Analysis on the semi-finished product revealed a total oxygen content of 6 ppm and a hydrogen content of 3 ppm.

COMPARATIVE EXAMPLES

The same steel as in Example 2 was subjected to the same in-ladle treatment operation with reheating also for 1 hour but with conventional stirring. The samples were taken and analysed at the end of the same period after pouring and indicated a total mean oxygen content of 11 ppm and a hydrogen content of 7 ppm.

Consequently the steel treated in accordance with the process of the invention was found to have an average drop of 4 ppm of hydrogen and a total oxygen value of about 1.5 times the level of activity of the oxygen in the ladle at the end of the treatment.

The process and the ladle may be applied to inladle treatment of a very wide range of different steels of all types and all compositions.

Obviously, numerous modifications and variations of the present invention are possible in light of the above teachings. It is therefore to be understood that within the scope of the appended claims, the invention may be practiced otherwise and as specifically described herein.

We claim:

1. A process for treatment in a ladle of a liquid steel by at least one gas injected through the ladle bottom, in which the gas-metal exchange surfaces are multiplied with retention of the individuality of each small gas bubble and their low rate of rise, and with prevention of bubble coalescence, comprising the step of:

injecting said gas through injection elements, the total area of said elements being between S/10 and S/30, where S is the area of the bottom of the ladle, wherein said injection elements are disposed at a distance from the center of the bottom of the ladle which is at least equal to half the radius of the bottom of the ladle and spaced from the internal wall of the ladle by a distance which is at least equal to 1/10th of said radius and wherein the mean unitary gas flow rate per $cm^2$ of area of the injection elements is between 0.1 and 0.8 1/minute, wherein said elements are pores whose unitary cross section is less than 0.8 $mm^2$, the total area being between 15 and 40 $mm^2$ per $dm^2$ of injection elements, or said elements are slots whose thickness is less than 0.4 mm, the total area being between 45 and 105 $mm^2$ per $dm^2$ of area of injection elements.

2. The process of claim 1, wherein said injection elements are disposed in a continuous or discontinuous annular zone, wherein the angular width of a zone without injection element, as seen from the center of the bottom of the ladle, is no greater than 30°.

3. The process of claim 1, wherein said elements are slots separated from each other by a distance of between 1 and 3 cm.

4. The process of claim 1, wherein the liquid steel is covered with an active slag, the composition of which is appropriate to the desired metallurgical treatment, being capable of coming together in a mass at the center of the upper surface of the steel in the ladle during the injecting operation.

5. The process of claim 1, further comprising decanting solid inclusions from said ladle while injecting a neutral gas.

6. The process of claim 5, wherein said neutral gas is an inert gas in air, carbon dioxide, nitrogen or a mixture thereof.

7. The process of claim 1, wherein said treatment is dehydrogenation and said gas is an inert gas in air, carbon dioxide, nitrogen gas or a mixture thereof.

8. The process of claim 1, wherein said treatment is nitriding and said gas is nitrogen.

9. The process of claim 1, wherein said treatment is decarburization, said gas is a mixture of an inert gas in the air or nitrogen and oxygen, wherein the partial pressure $P_{co}$ resulting from combustion is that required by the thermodynamic equilibria governing the proportion of carbon and the oxygen dissolved in the liquid steel at the temperature of the liquid steel during the treatment.

10. The process of claim 1, wherein said ladle is provided with a cover for giving protection from the outside atmosphere during the injecting operation.

11. The process of claim 1, wherein during the injecting step, the liquid steel is reheated by means of at least one electric arc produced by means of at least one electrode disposed above the center of the ladle.

12. The process of claim 1, wherein said injection elements are made of refractory material.

13. The process of claim 12, wherein said injection elements are cylindrical, conical, pyramidal, or parallelepipedic.

14. The process of claim 1, wherein said injection elements have a plurality of faces and the faces of the injection elements, except that face which is in contact with the liquid steel, are covered with a steel plate which plate is connected to a tube for the supply of the said gas.

15. The process of claim 14, wherein the supply of said gas to the whole of the injection elements is effected from a central supply.

16. A ladle for effecting the treatment of steel in accordance with claim 1, comprising a ladle having a ladle bottom comprising injection elements connected to gas supply means, wherein the total area of the injection elements is between S/10 and S/30, wherein S is the area of the ladle bottom, said injection elements being disposed at a distance from the center of the ladle bottom which is at least equal to half the radius of the ladle bottom and spaced from the internal wall of the ladle by a distance which is at least equal to a tenth of said radius, wherein said injection elements are passages or pores whose unitary cross section is less than 0.8 $mm^2$, the total area being between 15 and 40 $mm^2$ per $dm^2$ of injection element, or said elements are slots whose thickness is less than 0.4 mm, the total area being between 45 and 105 $mm^2$ per $dm^2$ of injection element.

17. The ladle of claim 16, wherein said injection elements are slots.

18. The ladle of claim 17, wherein said slots are straight.

19. The ladle of claim 17, wherein said slots are curved.

20. The ladle of claim 16, wherein said injection elements are slots, and are separated from each other by a distance of between 1 and 3 cm.

* * * * *